United States Patent [19]

Bellows

[11] Patent Number: 4,558,732

[45] Date of Patent: Dec. 17, 1985

[54] ELEMENT BASKET FOR ROTARY REGENERATIVE HEAT EXCHANGERS

[75] Inventor: Kenneth O. Bellows, Jacksonville, Fla.

[73] Assignee: The Air Preheater Company, Inc., Wellsville, N.Y.

[21] Appl. No.: 739,392

[22] Filed: May 30, 1985

[51] Int. Cl.[4] ..... F28D 19/04

[52] U.S. Cl. ..... 165/8; 165/10

[58] Field of Search ..... 165/8, 10

[56] References Cited

U.S. PATENT DOCUMENTS 3,996,997 12/1976 Regan et al. ..... 165/10

4,182,402 1/1980 Adrian ..... 165/10

*Primary Examiner*—Albert W. Davis, Jr.

*Attorney, Agent, or Firm*—William W. Habelt

[57] ABSTRACT

An arrangement for compressing together a bundle of laterally abutting heat absorbent element sheets (14) in an element basket (32) for a rotary regenerative heat exchanger. Spring action loading plates (28) formed with arcuate ridges (30) are compressed against the end sheet of the element bundle. The arcuate ridges (30) of each loading plate (28) are arranged transverse to the flow of fluid through the basket of element (14) sheets in order that pressure may be applied evenly to all sections of the element sheets holding them in a uniformly tight relationship.

4 Claims, 3 Drawing Figures

ELEMENT BASKET FOR ROTARY REGENERATIVE HEAT EXCHANGERS

BACKGROUND AND SUMMARY OF THE INVENTION

The present invention relates to an improved biasing arrangement for holding adjacent heat absorbent element sheets of a rotary regenerative heat exchanger in a continuously tight relationship.

In rotary regenerative heat exchange apparatus a mass of tightly packed heat absorbent element sheets is contained in a rotor that is slowly rotated about its axis. The rotor is comprised of a cylindrical rotor shell and divided into sector shaped compartments that house element baskets that contain sheets of heat absorbent material. A basket of heat absorbent material is first positioned in a gas passageway to absorb heat from gases passing therethrough, and then as the element becomes heated it is slowly rotated into a second passageway where it gives up its heat to cooler air passing therethrough. Movement of the rotor is usually continuous so there is a uniform transfer of heat from the hot gas to the cooler air. Some or all of the element sheets are usually formed with corrugations or other formations that extend between inlet and outlet ends of the rotor to direct gas and air flow therethrough and to act as stiffeners for the individual sheets.

The gas passing through the heat exchanger is not only hot but very corrosive, but also has particles of flyash therein, thus the element quickly corrodes and erodes from the effects of the gas. As the sheets of element corrode, and erode, thus becoming thinner and more brittle, they become loose and begin to vibrate until they break up and cause a complete loss of effectiveness.

This vibration is caused particularly by a blast of high pressure air or steam being blown through the spacing between element sheets to remove deposits such as soot and flyash therefrom. Additional vibration of the heat exchange plates is caused by continuous rotation of the rotor. This is especially true when the rotor is being moved about a horizontal axis. Thus, as the rotor is turned about its axis, the plates loosened by corrosion and erosion are further agitated and break apart. Attempts have been made to correct this untenable condition by arrangements shown in U.S. Pat. No. 3,379,240 of Bellows and Woolard, and U.S. Pat. No. 3,314,472 of Krumm and Casagrande.

In U.S. Pat. No. 3,379,240 an arcuate pressure plate with a single arcuate ridge is arranged with the ridge parallel to the flow of gas and air through the rotor. This pressure plate exerts a force along it's opposite surfaces parallel to to the corrugations or other formations on the element sheets. U.S. Pat. No. 3,314,472 discloses an arcuate spring plate with a single arcuate ridge exerting a force against the center of each basket which also lies parallel to the flow of fluid through the heat exchanger and generally parrallel to the corrugations of the element sheets.

While both arrangements defined by the foregoing patents are partially effective, they fail to exert a constant, even force on widely spaced portions of the element sheets for long periods of operation. Moreover the arcuate spring plate tend to exert a concentrated force along a single line that bends the element and causes premature breakage. Furthermore, line of contact between the spring plate and the adjacent element extends parallel to the line of fluid flow through the heat exchanger and thereby lies substantialy parallel to the corrugations shown on the adjacent element sheets. Therefore, portions of each element sheet that lie remote from contact with the spring plate tend to vibrate and quickly deteriorate until they are ultimately destroyed.

SUMMARY OF THE INVENTION

An element basket is provided for a rotary regenerative heat exchanger to house a bundle of stacked heat absorbent element sheets, having generally longitudinal formations therein to permit flow of fluid between adjacent sheets, which are disposed between spaced loading means disposed at opposite ends of the bundle. Compression means interconnect the spaced loading means to compress the loading means against the laterally abutting sheets to firmly hold the sheets in position. The loading means include a plurality of elastic loading projections extending essentially transverse to the longitudinal formations in the element sheets and exert an even pressure against the intervening heat absorbent element sheets.

The present invention therefore contemplates an arrangement that maintains a series of laterally abutting heat absorbent element sheets disposed with an element basket for a rotary regenerative heat exchanger in a state of uniform compression to preclude looseness, agitation, and eventual fracture thereof. The apparatus maintains the heat absorbent element sheets in a tight condition even if they have been subjected to severe corrosion and erosion by the fluids flowng therethrough. Another advantage achieved by the present invention is that it embodies spring acting means that places a widely distributed compressive force upon each heat exchange plate lying adjacent thereto. Moreover, the spring acting loading means disclosed herein achieves the foregoing action without subjecting each of the element plates to a concentrated bending force that might itself bend the element sheets beyond their elastic limit and thus negate the spring action thererof.

DESCRIPTION OF SPECIFIC EMBODIMENT OF THE INVENTION

Figure 1:
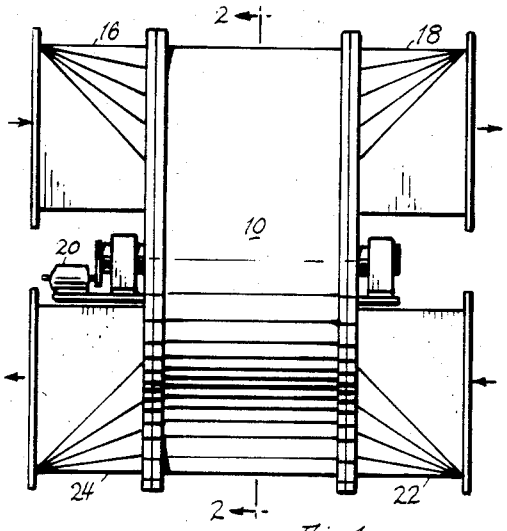
FIG. 1 is a perspective view of a rotary regenerative heat exchanger having a horizontally disposed rotor post.
Figure 2:
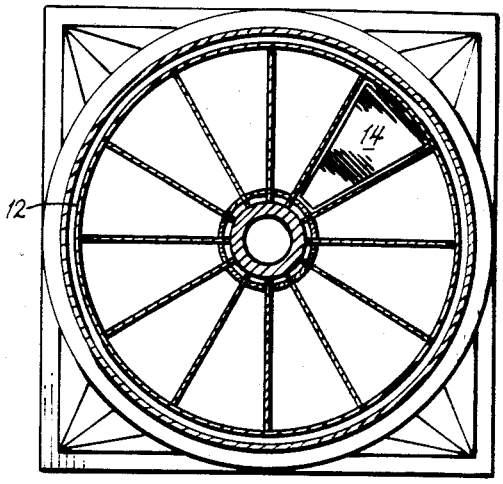
FIG. 2 is a cross section of as seen from line 2—2 of FIG. 1.

As illustrated in the drawing the heat exchange apparatus comprises essentially a housing 10 enclosing a rotor 12 containing layers of heat exchange sheets 14 that are contacted by a stream of hot gas entering the housing through an inlet duct 16 and exhausted through an outlet duct 18 after having traversed the heat exchange material in the sector shaped compartments therebetween. Cool air entering the housing through inlet 22 is exhausted through outlet duct 24 after having traversed the heat exchanger. While the hot gas and cool air are passng through the heat exchanger the rotor 12 is being continuously rotated about its axis by drive means 20 in order that each segment of heat exchange element may be alternately subjected to the hot gas and cooler air.

The heat exchange material carried by the rotor comprises a plurality of heat exchange sheets 14 having generally longitudinal formations therein, such as corrugations or spacing projections, that provide flow passageways between adjacent sheets for the flow of hot gas and cooler air. The sheets are assembled in an orderly array and positioned in a U-shaped basket 32 that firmly holds them in an assembled mass so they may be easily positioned within the rotor of the heat exchanger. If desired, additional flat heat exchange sheets may be disposed between adjacent sheets 14.

Each basket includes a spring acting loading plate 28 at the inner and outer ends thereof, the loading plates being positioned laterally adjacent the innermost and outermost of the intervening heat exchange element sheets whereby compression of the loading plate will impact a compressive force to the intervening heat exchange sheets to thus preclude element looseness, vibration and breakage.

The loading means 28 are held in a compressed relation by an end plate 36 or an equivalent holding device which is secured to the end edges of open side of the U-shaped basket 32. The edges of basket 32 adjacent both inlet and outlet ends thereof are preferably formed with flanges 34 that provide narrow retaining strips to basket the element sheets and hold them within the basket. The method of assembling each basket of element, compressing the element, and then securing it in a compressed relation is well known in the art and is generally covered by U.S. Pat. Nos. 3,314,472 and 3,379,240.

Figure 3:
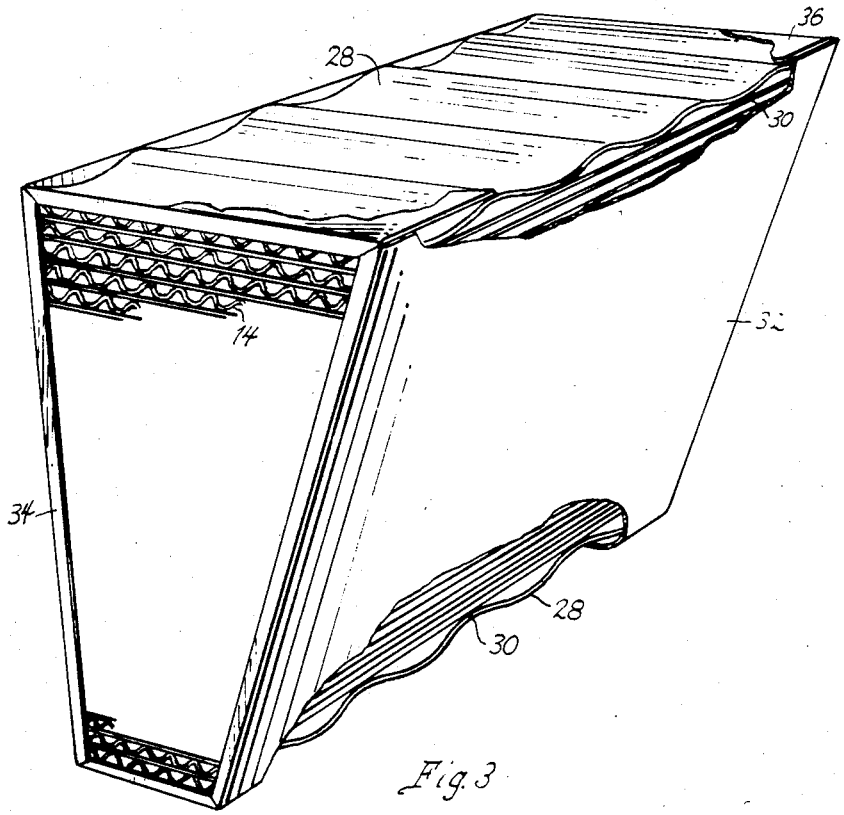
FIG. 3 is a perspective view of the invention as defined in the accompanying specification.

According to this invention, the loading means 28, comprising a plurality of elastic loading projections 30, extend across the ends of the basket at spaced intervals generally transverse to the flow of fluid through the basket. In the preferred embodiment, as shown in FIG. 3, the loading means comprise spaced plates 28, each having a transverse spring-acting series of undulations therein in the form of arcuate ridges 30. However, the loading means of the present invention is not limited to the embodiment shown in FIG. 3. For example, the loading means may comprise a plurality of individual arcuate or U-shaped plates disposed edge-to-edge at the ends of the basket sandwiched between the adjacent element stack and the basket ends to provide a series of spaced projections extending generally transverse to the flow of fluid through the basket.

Inasmuch as the ridges 30 in contact with the intervening heat exchange sheets forming the element bundle lie essentially transverse to the flow of fluid through each basket. The ridges 30 similarly extend transverse the corrugations of each element sheet 14 thereby forming a system of contact points widely distributed over the element sheets. Therefore, the spring action of loading means 28 is applied evenly across all sections of the stacked element sheets. By providing a plurality of loading projections, such as ridges 30, on each pressure plate 28, the span between transversely and longitudinally spaced bearing points is therefore reduced so that looseness, vibration and buckling of the element is reduced, and the life expectancy of the element is materially increased.

What is claimed is:

1. A basket of heat absorbent element sheets for a rotary regenerative heat exchanger having open ends that comprise inlet and outlet ports for the flow of fluid over the plates of the heat exchanger, said basket comprising a bundle of laterally abutting heat absorbent element sheets having generally longitudinal formations therein to permit the flow of fluid therethrough, spaced loading means disposed at opposite ends of the bundle of laterally abutting heat absorbent element sheets so as to hold the intervening heat absorbent element sheets in abutting relationship, the loading means providing a plurality of elastic loading projections extending essentially transverse to the longitudinal formations, and means interconnecting the spaced loading means so as to compress the loading means against the laterally abutting sheets whereby the loading projections are exerted evenly against the intervening sheets of heat absorbent material.

2. An element bundle for a rotary regenerative heat exchanger as defined in claim 1 wherein said loading means provide at least two spaced elastic loading projections, one lying closer to the inlet end and one lying closer to the outlet end of said element basket to preclude lateral movement of the intervening heat absorbent element sheets.

3. An element bundle for a regenerative heat exchanger as defined in claim 2 wherein the loading means comprises a plate having a plurality of spring-like undulations having arcuate ridges that lie transverse to the longitudinal formations of the heat absorbent element sheets.

4. An element bundle for a rotary regenerative heat exchanger, as defined in claim 1 wherein the elastic loading projections of the loading means extend substantially across the entire element basket to provide support for the element sheets therebetween.

* * * * *